US006076824A

United States Patent [19]

Oppliger et al.

[11] Patent Number: 6,076,824

[45] Date of Patent: Jun. 20, 2000

[54] APPARATUS FOR DECOLLATING FLAT OBJECTS CONVEYED IN FORM OF VERTICAL STACKS

[75] Inventors: Jean-Claude Oppliger, Niederhasli, Switzerland; Thomas Zimmermann, Wutöschingen, Germany

[73] Assignee: Grapha-Holding AG, Hergiswil, Switzerland

[21] Appl. No.: 08/990,669

[22] Filed: Dec. 15, 1997

[30] Foreign Application Priority Data

Dec. 20, 1996 [CH] Switzerland ..... 3144/96

[51] Int. Cl.[7] ..... B65H 1/02

[52] U.S. Cl. ..... 271/150; 271/265.01; 271/34; 271/149

[58] Field of Search ..... 271/31.1, 150, 271/151, 152, 153, 154, 149, 94, 95, 34, 265.01

[56] References Cited

U.S. PATENT DOCUMENTS

| | | | |
|---|---|---|---|
| Re. 34,894 | 4/1995 | Golicz | 271/150 X |
| 3,690,474 | 9/1972 | Klappenecker | 271/3.13 |
| 3,894,732 | 7/1975 | Muller | 271/150 X |
| 3,981,493 | 9/1976 | Klappenecker et al. | 271/150 X |
| 4,077,620 | 3/1978 | Frank | 271/10.03 |
| 4,235,432 | 11/1980 | Marschke | 271/153 X |
| 4,302,000 | 11/1981 | Frank | 271/150 |
| 4,523,753 | 6/1985 | Hiromori et al. | 271/31.1 |
| 4,595,188 | 6/1986 | Wiley et al. | 271/4 |
| 4,634,111 | 1/1987 | Frank | 271/150 X |
| 4,853,063 | 8/1989 | Basgil et al. | 271/31.1 X |
| 4,884,797 | 12/1989 | Svyatsky | 271/150 X |
| 5,092,574 | 3/1992 | Braen et al. | 271/150 X |
| 5,246,223 | 9/1993 | Ricciardi et al. | 271/149 |
| 5,249,788 | 10/1993 | Helmstadter | 271/150 X |
| 5,839,015 | 11/1998 | Faguy et al. | 271/153 X |

FOREIGN PATENT DOCUMENTS

| | | | |
|---|---|---|---|
| 2 442 784 | 6/1980 | France | B65H 3/06 |
| 2-204225 | 8/1990 | Japan . | |
| 4-303349 | 10/1992 | Japan . | |
| 4-354736 | 12/1992 | Japan . | |
| WO 96/22242 | 7/1996 | WIPO | B65H 3/04 |

OTHER PUBLICATIONS

European Search Report for CH 314496.

IBM Technical Disclosure Bulletin, vol. 19, No. 7, published Dec. 1976.

*Primary Examiner*—Christopher P. Ellis
*Assistant Examiner*—Patrick Mackey
*Attorney, Agent, or Firm*—Darby & Darby

[57] ABSTRACT

An apparatus (1) for decollating juxtaposed flat objects (3) conveyed in form of vertical stacks is comprised of a conveyor (2) having a continuous loop traction mechanism (4) and a decollation unit (7) for removing the objects (3) individually from the front end of the stack (6) in a lateral direction, wherein the decollation unit (7) moves forward and backward, respectively, in relation to the front end of the stack (6), with the movements initiated by a transmitter (16) which is connected to the decollation unit (7) and faces the front end of the stack (6), based on the distance between the transmitter (16) and the front end of the stack (6).

14 Claims, 3 Drawing Sheets

APPARATUS FOR DECOLLATING FLAT OBJECTS CONVEYED IN FORM OF VERTICAL STACKS

BACKGROUND OF THE INVENTION

1. Field of the Invention

The present invention relates to an apparatus for decollating flat objects conveyed in form of vertical stacks, such as envelopes, cards, correspondence pockets, bags, packages or prints, the apparatus comprised of a conveyor formed by a continuous loop traction mechanism for transporting the objects and oriented transversely to the feed direction, and a decollation unit associated with the conveyor, wherein the decollation unit is constructed as to be capable of advancing in the feed direction of the conveyor against the front end of the stack of objects and provided with a extraction section disposed on a conveyor channel of a continuous loop conveyor driven perpendicular to the feed direction of the stack.

2. Description of the Related Art

An apparatus of this type is described in WO 96/22242. When processing flat objects, the decollation unit which is biased against the front end of the stack, operates rather slowly and tends to break down under rapidly changing conditions. This situation can only be corrected manually which takes up valuable production time.

Moreover, the decollation unit is disadvantageously biased against the end of the stack, thereby promoting adhesion between the juxtaposed flat objects, which causes errors during removal from the end of the stack, such as double pages or blank pages.

SUMMARY OF THE INVENTION

It is therefore an object of the invention to provide an apparatus of the aforedescribed type which obviates the disadvantages mentioned above and which exhibits a fast response time during processing of the objects.

The object is solved by the invention in that the decollation unit includes at least one transmitter facing the front end of the stack of objects to be transported for initiating a reverse or forward motion, respectively.

The invention thus provides a novel approach by moving the stack end with a greater force and by partially loosening the stack in the capture zone for reliably separating the individual objects from the stack.

It is another advantageous feature of the invention that the transmitter is designed to measure a physical quantity for determining the distance between the transmitter and the front end of the stack and that the measured distance values are associated with the movements or with a stoppage of the decollation unit. Physical quantities suitable for this purpose are, for example, light such as laser or infrared radiation, sound waves such as ultrasound, or a force generated by mechanical or pneumatic means.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 2:
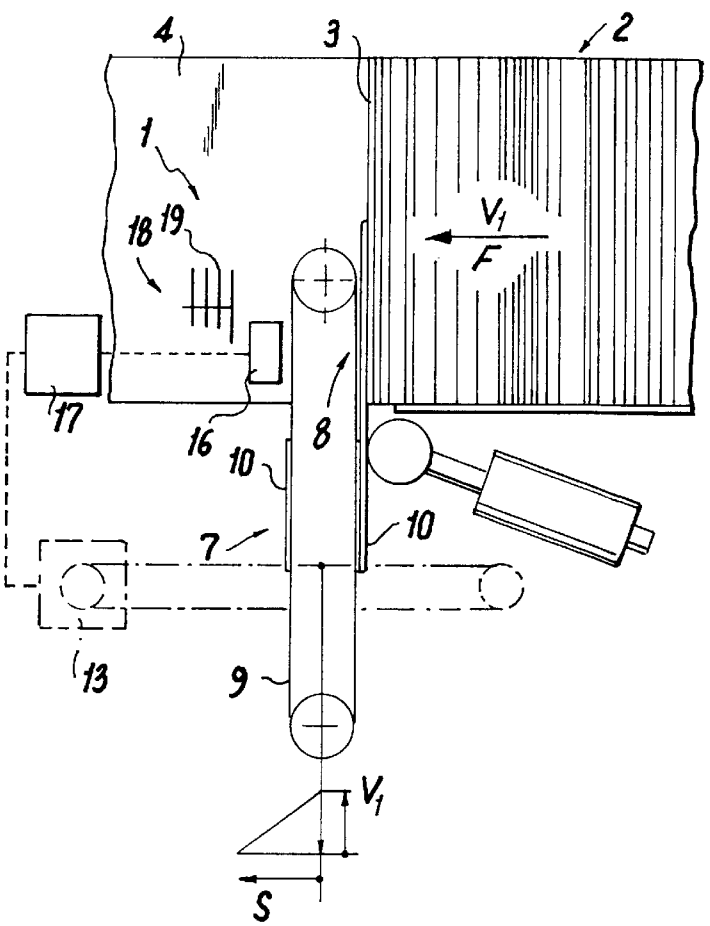
FIG. 2 is the apparatus of FIG. 1 in the starting position for processing flat objects.

FIGS. 1 to 5 illustrate an apparatus 1 for decollating flat objects 3 which are conveyed on a conveyor 2 in form of vertical stacks, such as envelopes, cards, correspondence pockets, bags, packages or prints. The conveyor 2 is formed by a continuous loop traction mechanism 4 or belt; on the upper conveyor level transverse to the feed direction F, the objects 3 are juxtaposed in compartments (not shown) formed by two respective spaced walls. Laterally on the belt 4 there is disposed a guide member 5 for guiding the objects 3. A decollation unit 7 forming the feed end of the conveyer 2 is associated with the front end of the stack 6, so that the decollation unit 7 can of be biased against and moved away from the front end of the stack 6. The decollation unit 7 is also provided with a discharge section 8 of a hoistway 22 facing the front of the respective stack for gripping the objects 3 and removing the objects 3 perpendicularly to the feed direction of the conveyed stack. The objects are gripped and removed by a conveyor 9 circulating about axes 11 which are oriented perpendicular to the conveying plane of the conveyor 2, with two adhesion segments 10 disposed lengthwise along the conveyor 9 and with the back side of the adhesion segments 10 in the region of the discharge section 8 connected to a vacuum chamber for extracting the object 3 from the stack and removing the respective most forward object 3 to the side (see FIGS. 2 to 4).

Figure 1:
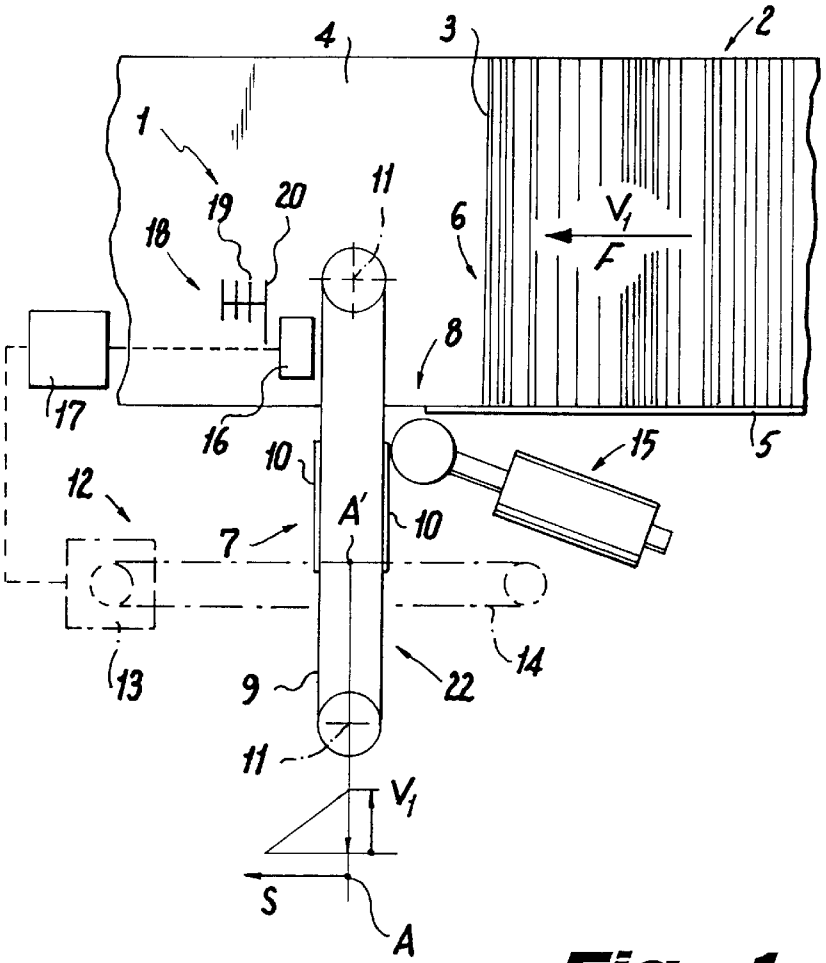
FIG. 1 is an embodiment of the invention in a starting position.

Referring now to FIG. 1, there is shown the apparatus 1 in the starting position, wherein the forward end of the stack 6 has not yet reached the discharge section 8 of the decollation unit 7. As noted in FIGS. 1 to 5 and referring to the feed direction F and in the corresponding displacement/velocity diagram $S/V_1$, the feed velocity is greater than the processing speed $V_1$ until the region proximate to the front of the decollation unit 7 is reached. The higher feed velocity is reduced to the adjustable processing speed $V_1$ shortly before reaching the discharge section 8—rather analogous to the feed motion of a machine cutting tool.

The decollation unit 7 presumes that the stack is positioned in the forward end position as indicated by A, A' in FIG. 1. The reverse—as well as the forward—movement out of the forward end position is effected by a drive 12 indicated by dot-dashed lines. For this purpose, there is provided a frame (not visible) of the decollation unit 7 disposed in a guide assembly extending parallel to the feed direction F, with the decollation unit capable of being moved in the forward direction, i.e. towards the front end of the stack 6, as well as in the reverse direction, i.e. away from the front end of the stack. These movements can, for example, be generated by a circulating traction means 14, a chain or a toothed belt connecting a controlled gear motor 13 with the frame of the decollation unit. For sake of completeness, it is pointed out that the objects 3 which are collected at the front end of the stack of the decollation unit 7, pass a stripper unit 15 which prevents an adhesion segment 10 from removing multiple objects 3.

An essential feature contributing to the success of this apparatus 1 is a transmitter 16—indicated by an arrow—for determining the movements or a stoppage of the decollation unit 7. The transmitter 16 faces the front end of the stack or the free-standing surface of the most forward object 3, respectively, and is connected to a controller 17 shown in the figures in symbolic form.

The controller 17 transmits signals which are triggered by the transmitter 16, to the drive unit 12 or to the motor 13, respectively, for moving the decollation unit 7 on the guide assembly.

The decollation unit 7 is controlled by measuring the distance between the frame of the decollation unit 7 and the front stack end 6 of the objects 3. The distance is measured by using appropriate physical quantities. Capable of measuring such physical quantities are devices using light, ultrasound and mechanical means, wherein the first two types of devices can also be used in reflection mode and include a transmitter and receiver for transmitting rays or waves.

In this case, the distance values which are to be determined, are associated with a respective forward motion, a reverse motion or a stoppage in the motion of the decollation unit 7.

The distance is measured on a measured section 18 which is subdivided into two segments 19, 20 as seen from FIGS. 1 to 5. The ends of the measured section 18 formed by the segments 19, 20 are correlated with the movements of the decollation unit 7, wherein the end of the measured section 18 which is farther away from the front end of the stack 6, is associated with the reverse motion of the decollation unit 7, whereas the end of the measured section 18 which is closer to the front end of the stack 6, is identified with initiating the forward motion of the decollation unit 7. Although the status of the measured section 18 depicted in FIG. 1 corresponds to a forward motion of the decollation unit 7, the decollation unit 7 is shown stationary in the forward end position A, A'.

If the distance is measured mechanically, the transmitter 16 for determining or initiating, respectively, the movements of the decollation unit 7 can be constructed, for example, in form of a touch sensor facing the respective most forward object 3 of the stack. This would also be the case for other transmitters 16 responsive to different physical quantities. When the objects 3 are withdrawn laterally by the decollation unit 7, an instant gap to the subsequent object 3 is created; this gap causes the touch sensor to surge forward or a ray or a wavelength to undergo a change which once more urges the decollation unit 7 in a forward direction.

The distance by which the decollation unit 7 moves forward as a result of the gap, increases with increasing thickness of the withdrawn object(s) 3. The individual process steps during the operation of the apparatus 1 will now be described with reference to FIGS. 2 to 5.

In FIG. 2, the stack comprised of objects 3 having different thicknesses has arrived at the removal section 8 of the decollation unit 7; the reverse motion of the decollation unit 7 has just been initiated or is expected to occur shortly as a result of the close proximity between the stack and the transmitter 16. This situation is depicted in the distance/velocity diagram of FIG. 2. The conveyor 9, for example, is provided with two adhesion segments 10 disposed along its length, similar to the adhesion segments disclosed in WO96/38361.

Figure 3:
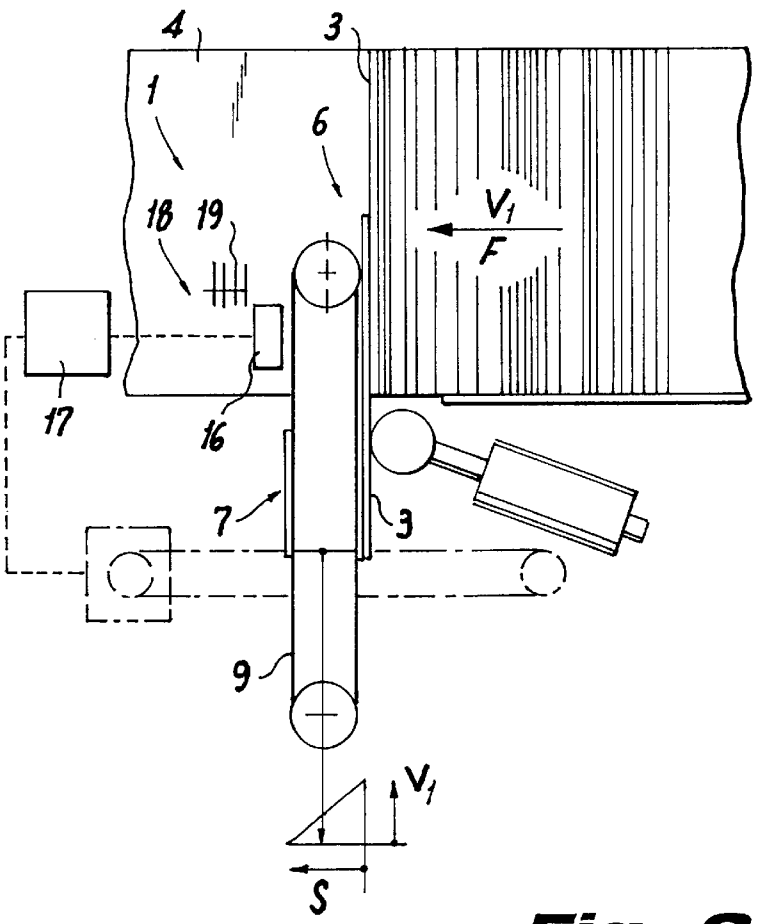
FIG. 3 is the same apparatus after the decollation unit has moved in the reverse direction.

When the objects 3 approach, the distance to the most forward object 3 becomes zero for a brief moment. As a result, the transmitter 16 on the measured segment 18 initiates the reverse motion of the decollation unit 7, as is illustrated in FIG. 3.

In contrast to FIG. 2, the decollation unit 7 then moves backward together with the front end of the stack 6, wherein according to the distance/velocity diagram, the feed velocity $V_1$ of the conveyor 2 has been reduced to approximately half of its previous value and now matches the velocity of the decollation unit 7. It may, however, also happen that the decollation unit 7 either moved forward or stopped since the time the decollation unit 7 was in the state illustrated in FIG. 2, whereas the circulating conveyor 9 of the decollation unit 7 operated without interruption and/or continuously removed objects 3 from the front end of the stack 6. Under the processing conditions shown in the example, the decollation unit 7 is moving in the reverse direction, i.e. away from the forward end position A, A', in accordance with the position of the transmitter 16 on the measured segment 18.

Figure 4:
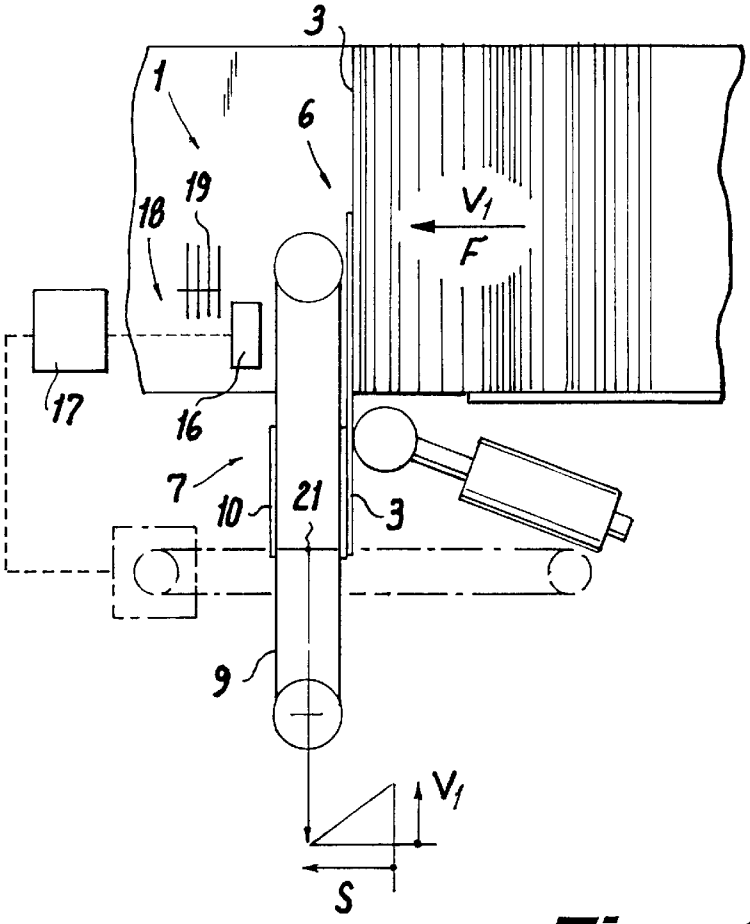
FIG. 4 is the decollation unit of the apparatus in a rearward operating position.

Referring now to FIG. 4, there is shown the apparatus 1 in a situation wherein the front end of the stack 6 has stopped and the decollation unit 7 has attained a rearward position or a switching position 21, and the feed motion of the conveyor 2 is interrupted. The stack size continues to shrink, whereas the decollation unit either stops or moves farther back with the same velocity or with a higher velocity than before.

Figure 5:
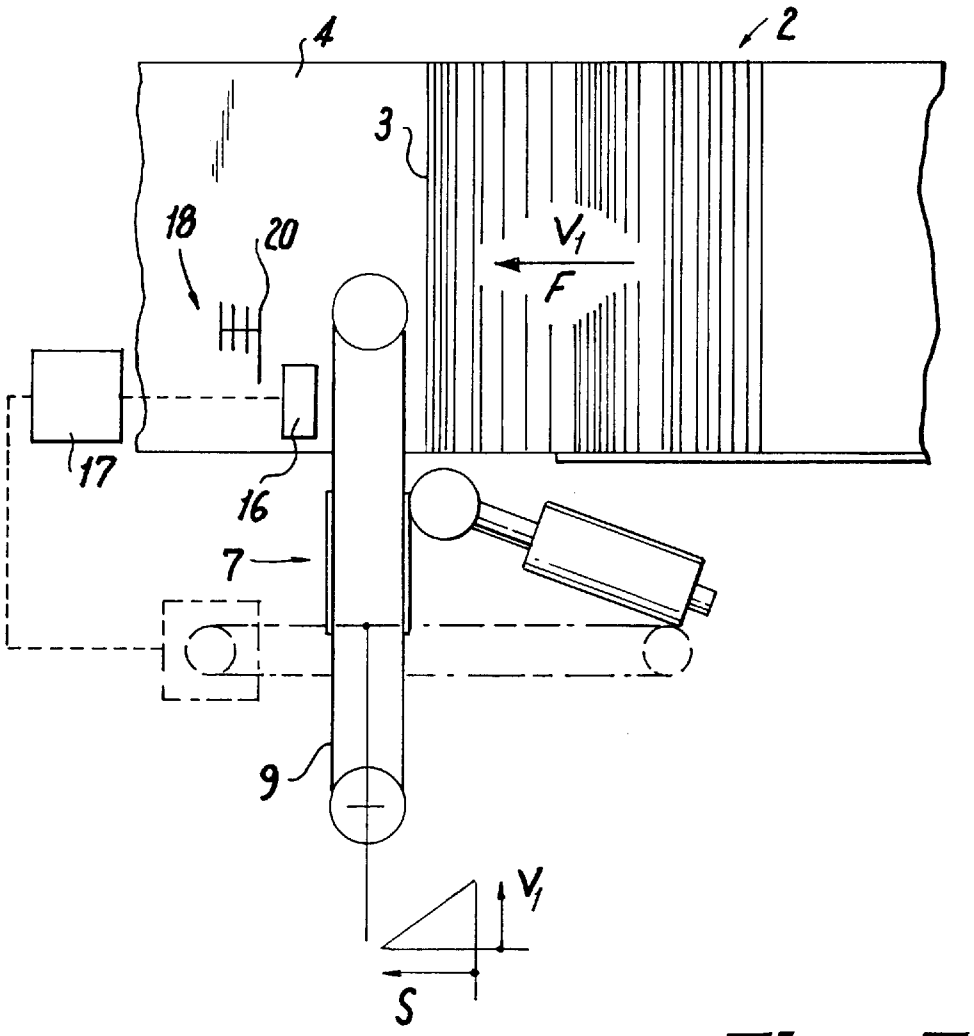
FIG. 5 is the decollation unit in the most rearward operating position.

Consequently, the distance between the transmitter 16 and the front end of the stack 6 increases—although no objects 3 are removed from the front end of the stack 6. As a result, the controller 17 initiates a forward motion of the decollation unit 7 for subsequently decollating the objects in the stack. This is shown in FIG. 5.

In general, gaps between the transmitter 16 and the front end of the stack 6 initiate a forward motion of the decollation unit directed towards the front end of the stack, whereas the absence of gaps between the transmitter 16 and the front end of the stack 6 initiates a backward movement or a stoppage or a feed interruption of the decollation unit 7. The feed interruption of the decollation unit 7 is reversed, i.e. feeding resumes, when the decollation unit 7 moves forward between the rear end position and the forward end position A, A'.

For attaining an optimum detachment in the capture zone and for alternately releasing the transmitter from the stack end, it is advantageous if the decollation unit moves in the reverse direction at the same velocity or at a larger velocity than the conveyor.

Advantageously, the design can be kept simple, if the transmitter on the decollation unit is secured to a frame which can be driven by a motor, thereby providing a direct functional correlation between the conveyor and the decollation unit.

For automatic processing of the objects by the proposed apparatus, the transmitter is preferably connected to a controller effecting a drive unit which generates the movements of the decollation unit.

In another preferred embodiment, there is associated with the transmitter a measured section which is subdivided into segments for, among others, associating the movements of the decollation unit with these segments so that the objects can be processed economically.

For this purpose, the segments of the measured section are advantageously associated with the respective reverse and forward motion or with a stoppage of the decollation unit, respectively, thus providing a more precise control of the apparatus. In a particularly simple embodiment, the segment relating to the stoppage of the decollation unit is placed between the segments associated with the reverse and the forward motions on the measured section so that unambiguous control conditions can be established.

The transmitter is advantageously formed by an element capable of changing its position and measuring a quantity which changes physically along the measured section. If the velocity of the stack on the conveyor is too high in comparison to the processing speed of the decollation unit, then a switch position which is advantageously effected by the reverse motion of the decollation unit, interrupts the drive mechanism of the conveyor and controls the decollation unit in accordance with the segment of the measured section. The conveyor can be restarted by driving the decollation unit in the forward direction by a predetermined distance.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An apparatus for decollating juxtaposed flat objects conveyed in a vertical stack having a front end, comprising:

a first continuous loop conveyor for transporting the objects oriented transversely to a feed direction along a feed path;

a decollation unit displaceable in a direction opposite the feed direction against the front end of said vertical stack of objects, said decollation unit comprising:

a second continuous loop conveyor driven substantially perpendicular to the feed direction, said second conveyor having a discharge section of a hoistway;

driving means for displacing said decollation unit in the direction opposite the feed direction; and at least one transmitter facing the front end of said stack of objects to be transported for initiating reverse and forward motion.

2. The apparatus in accordance with claim 1, wherein said transmitter measures a physical quantity for determining a distance between said transmitter and the front end of said stack, one of movement and stoppage of said decollation unit being based on the measured distance values.

3. The apparatus in accordance with claim 1, said decollation unit during reverse motion having a velocity greater than or equal to a velocity of said first conveyor.

4. The apparatus in accordance with claim 2, wherein said decollation unit includes a frame, said transmitter being secured to said frame.

5. The apparatus in accordance with claim 4, further comprising a motor for driving said decollation unit.

6. The apparatus in accordance with claim 5, further comprising a drive unit for displacing said decollation unit.

7. The apparatus in accordance with claim 6, further comprising a controller electrically connected to said transmitter for controlling said drive unit.

8. The apparatus in accordance with claim 7, further comprising a measured section electronically connected to said transmitter, said measured section being subdivided into a plurality of segments.

9. The apparatus in accordance with claim 8, wherein each of said plural segments of said measured section are associated with at least one of reverse and forward motion, and stoppage of said decollation unit.

10. The apparatus in accordance with claim 9, wherein said segment associated with stoppage of said decollation unit is disposed between segments of said measured section associated with forward and reverse movement.

11. The apparatus in accordance with claim 10, wherein said transmitter measures a value which physically changes along said measured section.

12. The apparatus in accordance with claim 11, wherein said first conveyor is halted and said decollation unit is controlled based on said plural segments of said measured section upon said decollation unit, during reverse movement, reaching a switching position.

13. The apparatus in accordance with claim 12, wherein said second controller automatically controls removal of said objects from the front end of said stack.

14. The apparatus in accordance with claim 1, wherein said decollation unit is displaced as a function of positioning of the front end of said stack as determined by said transmitter.

* * * * *